United States Patent [19]

Mitchell

[11] 4,194,578

[45] Mar. 25, 1980

[54] RAISE BORING HEAD WITH RETRACTABLE GAGE CUTTERS

[75] Inventor: Howard E. Mitchell, Duncanville, Tex.

[73] Assignee: Dresser Industries, Inc., Dallas, Tex.

[21] Appl. No.: 910,724

[22] Filed: May 30, 1978

[51] Int. Cl.[2] ..... E21C 23/00

[52] U.S. Cl. ..... 175/53; 175/269; 175/344

[58] Field of Search ..... 175/53, 334, 342, 335, 175/382, 384, 267, 268, 263, 230, 381, 344; 299/60

[56] References Cited

U.S. PATENT DOCUMENTS

| | | | |
|---|---|---|---|
| 3,038,710 | 6/1967 | Robbins | 175/385 X |
| 3,232,670 | 2/1966 | Robbins et al. | 175/267 X |
| 3,285,667 | 11/1966 | Gonski | 175/267 X |
| 3,379,264 | 4/1968 | Cox | 175/334 X |
| 3,386,520 | 6/1968 | Lawrence et al. | 175/381 X |
| 3,387,893 | 6/1968 | Hoever | 175/267 X |
| 3,437,380 | 4/1969 | Lawrence | 175/230 X |
| 3,485,309 | 12/1969 | Lawrence | 175/230 |
| 3,486,572 | 12/1969 | Hamilton et al. | 175/53 |
| 4,010,808 | 3/1977 | Youngblood | 175/342 X |
| 4,083,416 | 4/1978 | Still et al. | 175/263 |

*Primary Examiner*—James A. Leppink
*Assistant Examiner*—Richard E. Favreau
*Attorney, Agent, or Firm*—Eddie E. Scott

[57] ABSTRACT

A raise boring system is provided that allows the raise boring head to be easily and efficiently lowered back through the completed raise hole. The raise head includes a multiplicity of rolling cutters positioned in saddles that are firmly affixed to the body of the raise head. These fixed saddles and rolling cutters comprise the primary cutting stage of the raise head. A multiplicity of retractable gage cutters are located radially outside of the primary cutting stage. The retractable gage cutters comprise rolling cutters positioned in moveable saddles. The moveable saddles and rolling cutters can be selectively withdrawn inside the primary cutting stage. A hydraulic-pneumatic system is provided for withdrawing the retractable gage cutters.

6 Claims, 9 Drawing Figures

RAISE BORING HEAD WITH RETRACTABLE GAGE CUTTERS

BACKGROUND OF THE INVENTION

The present invention relates to the art of earth boring and, more particularly, to a raise boring head for boring raise holes in a mine by enlarging a pilot hole into a raise hole having a larger diameter than the pilot hole.

A relatively large diameter hole may be provided between a first location and a second location in a mine or other underground works by an operation commonly referred to as raise drilling. A raise drilling operation begins by drilling a small diameter pilot hole through the earth from a first location to an opening at the second location using a small diameter pilot bit. After the pilot hole is completed, the pilot bit is removed from the drill string and a large diameter raise bit or raise head attached. The raise head is rotated and drawn along the pilot hole, thereby enlarging the pilot hole to the desired size.

As shown in U.S. Pat. No. 3,659,659 to Carl L. Lichte, patented by May 2, 1972, raise bits of the prior art generally include a bit body positioned about a central bit axis with rolling cutters mounted at various distances from the central bit axis for disintegrating the earth formations. The rolling cutters may be locked in place on the bit by various locking mechanisms. For example, locking mechanisms are shown in U.S. Pat. No. 3,203,492 to C. L. Lichte, patented Aug. 31, 1965; in U.S. Pat. No. 3,705,635 to William M. Conn, patented Dec. 12, 1972; and in U.S. Pat. No. 3,612,196 to Robert L. Dixon, patented Oct. 12, 1971. The cutters may be positioned to cut the working face according to various geometries. For example, cutter locations are shown in U.S. Pat. No. RE 27,597 to M. L. Talbert, patented Mar. 13, 1973, in U.S. Pat. No. 3,805,901 to William D. Coski, patented Apr. 23, 1974, and in U.S. Pat. No. 3,638,740 to Dan B. Justman, patented Feb. 1, 1972. A lubrication system may be provided to transmit lubricant to the bearings of the rolling cutters, as shown in U.S. Pat. No. 3,675,729 to William J. Neilson, patented July 11, 1972.

At the completion of many raise drilling operations it is necessary to lower the large diameter raise head back through the entire length of the hole that has been bored. For example, the earth boring machine that is drawing the raise head upward may block the area needed for completing the large diameter hole. In such cases the raise head is lowered back through the previously bored hole and the raise head removed. The earth boring machine is then removed and the earth formations broken through to complete the large diameter hole. The lowering of the raise head through the previously bored hole can be a very difficult procedure. The raise head may become stuck in the hole by being lodged on portions of the formations through which the hole extends. A raise boring head capable of being reduced in diameter prior to being lowered back through the previously bored hole would substantially reduce the risk of the raise head becoming stuck in the hole.

In addition, it is often necessary to lower the raise head down a partially completed raise. This may be necessary in order to change damaged or worn-out cutters or to remove and replace the raise head. Lowering of the raise head can be difficult and time consuming because the gage cutters have a tendency to hang up on the wall of the hole as the head is lowered. This is particularly true in non-vertical holes. Lowering the head can cause considerable damage to the gage cutters because the surf area of the cutters scrub the wall on the way down. In addition, the unsupported drill pipe and stabilizers are subjected to unusual loads which are believed to be prime factors in some premature drill string failures. After new cutters are installed and the raise head starts back up the raise hole, the new cutters will generally cut a slightly larger hole than the old, worn cutters did. The new gage cutters must ream this small amount of hole which causes excessive wear on the outer rows of the new gage cutters.

DESCRIPTION OF PRIOR ART

Prior to the present invention, the completion of a raise drilling operation often required lowering of the large diameter bit back through a portion or the entire length of hole that had been bored. The lowering of the raise head through the previously bored hole was a very difficult procedure. The raise head would on occasion become stuck in the hole by being lodged on portions of the formations through which the hole extended.

In U.S. Pat. No. 3,659,660 to William M. Conn, patented May 2, 1972, a large diameter bit for shallow angle holes is shown. The bit includes a plurality of drilling stages surrounding a central shaft. Integral stabilization sections are included after each drilling stage.

In U.S. Pat. No. 3,231,029 to Douglas F. Winberg, patented Jan. 25, 1966, an articulated drilling shaft for raise drilling is shown. The raise drilling bit shown in this patent includes a follower having an effective diameter when rotating that is substantially equal to the diameter of the raise hole that is being drilled by the cutterhead.

In U.S. Pat. No. 3,866,698 to John M. Stanley, patented Feb. 18, 1975, a raise drilling bit is shown for producing a raise bore about a pilot hole including a drill head having an upper surface for mounting cutter assemblies. A lower surface is spaced from said upper surface and has a drive stem attached thereto. The drive stem is adapted for a limited or floating movement with respect to said upper mounting surface.

In U.S. Pat. No. 4,010,808 to Thomas F. Youngblood, patented Mar. 8, 1977, an expandable raise bit is shown. A bit is provided that includes a bit body defining a bit axis of rotation. Primary cutter means are positioned on the bit body for disintegrating the formations out to a first radial distance from said bit axis of rotation. Secondary cutter means are adapted to be connected to the bit body and selectively located in a first position for cutting between said first radial distance and a larger second radial distance and selectively located in a subsequent position between said first radial distance and an even larger subsequent radial distance. Expansion means are provided to be located between said secondary cutter means and said bit body for locating said secondary cutter means in said subsequent position.

SUMMARY OF THE INVENTION

The present invention provides a raise boring system that allows the raise head to be lowered back through the completed portion of the raise hole. The raise head is lowered slightly away from the face. The gage cutters are retracted, decreasing the diameter of the raise head. This allows sufficient clearance along the wall of the hole to allow the raise head to be easily lowered. The worn cutters may then be replaced with new cutters and the head pulled back up the raise. As the head nears the face, the gage cutters are moved into their upper position for drilling. The above and other features and advantages of the present invention will become apparent from a consideration of the following detailed description of the invention when taken in conjunction with the accompanying drawings.

DETAILED DESCRIPTION OF THE INVENTION

Figure 1:
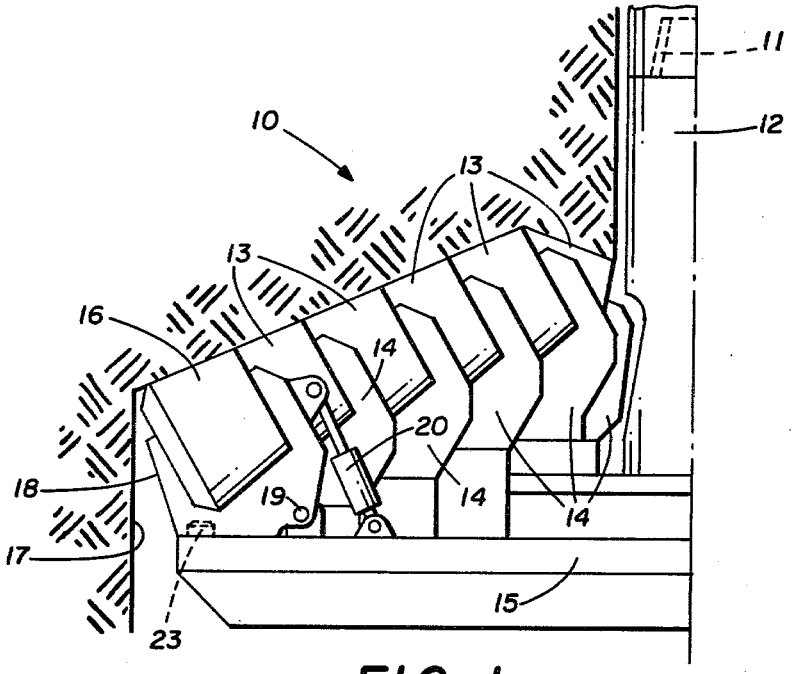
FIGS. 1 and 2 illustrate a raise head constructed in accordance with the present invention.

Referring now to the drawings and, in particular, to FIG. 1, a cutaway view of a raise head 10 constructed in accordance with the present invention is shown. A drive stem 12 projects from the main body portion of the raise head 10. The upper portion of the drive stem 12 is threaded with threads 11 to allow the raise head 10 to be easily connected to, and disconnected from, a rotary drill string (not shown). During the boring of a large diameter raise hole, a small diameter pilot hole is initially drilled from a first location to a second location. The small diameter pilot bit is disconnected from the drill string and a raise head such as raise head 10 is connected to the drill string. The drill string is rotated and an axial force is applied to the drill string. The raise head is rotated and drawn along the small diameter pilot hole to form the desired large diameter raise hole.

A multiplicity of rolling cutters 13 for disintegrating the formations out to a first radius from the central axis of raise head 10 form a portion of the body of raise head 10. The rolling cutters 13 are mounted in a series of cutter saddles 14 that form a portion of the body of the raise head 10. The plate 15 supports the saddles 14. It is to be understood that the raise head 10 includes other cutter saddles and cutters mounted around the stem 12 in a manner well known in the art. As the head 10 is rotated, the cutters 13 will contact and disintegrate the formations out to a first radius from the central axis of the raise head 10.

A multiplicity of gage cutters 16 are located radially outside the cutters 13 and are adapted to disintegrate the formations between the first radius and a second and greater radius from the central axis of the raise head 10. The cutters 16 cut what is known as the gage of the hole 17. The cutters 16 are mounted in cutter saddles 18. The cutters 16 and saddles 18 are also mounted on plate 15. The cutters 16 and saddles 18 can be selectively moved radially outward from the central axis of the raise head 10. The saddles 18 are connected to hinges 19 that allow the saddles 18 to be rotated outward to the gage cutting position. The rolling cutters 16 can thereby be selectively moved radially outward from the central axis of the raise head 10. A double-acting hydraulic cylinder 20 is connected between the plate 15 and the saddles 18. Actuation of cylinder 20 will move the cutters 16 radially inward or outward. The raise head 10 is shown with the gage cutters 16 expanded to the gage cutting position.

Figure 2:
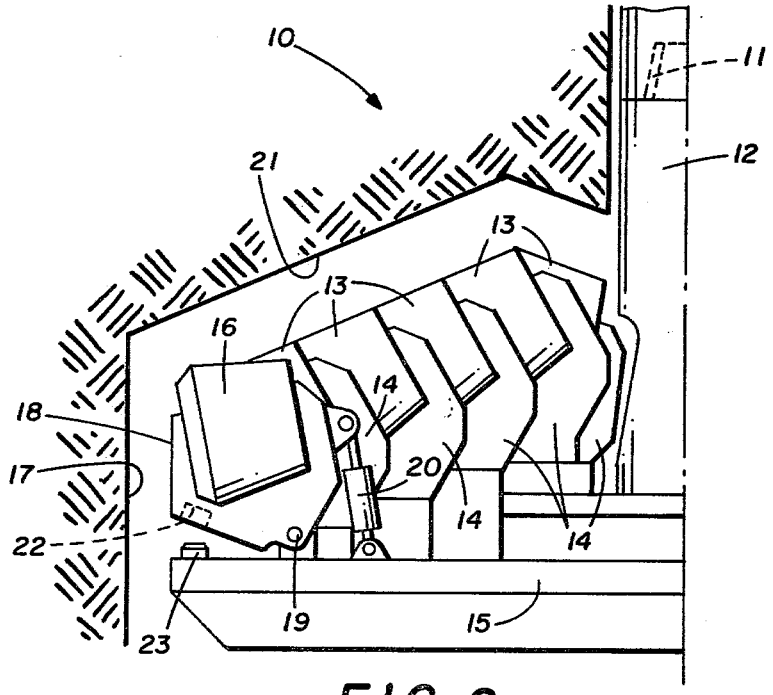
Figure 3:
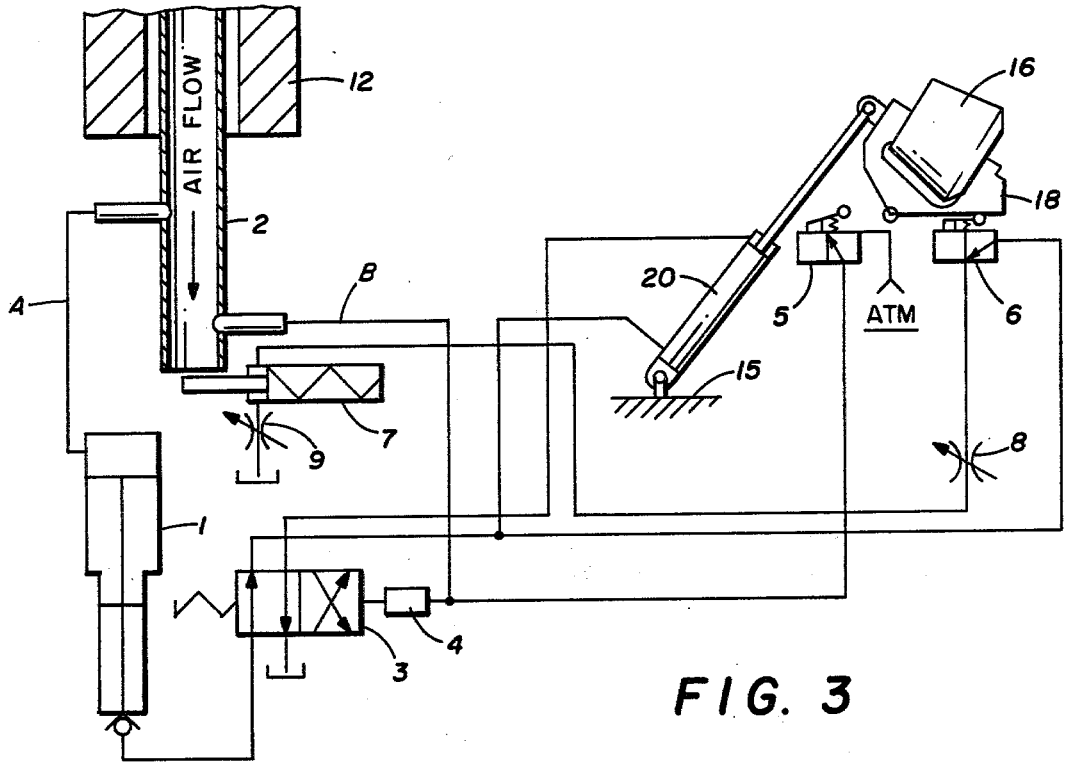
FIGS. 3–7 show circuit diagrams for extending and retracting the gage cutters of the raise head shown in FIGS. 1 and 2.

Referring now to FIG. 2, the raise head 10 is shown with the gage cutters 16 in the retracted position. The raise head 10 has been lowered slightly away from the face 21. The gage cutters 16 have been retracted hydraulically, decreasing the diameter of the raise head 10 an amount "A". The distance "A" is generally from two to twelve inches. This allows sufficient clearance along the wall 17 of the hole to allow the raise head 10 to be easily lowered. The worn cutters may then be replaced with new cutters and the head pulled back up the raise. As the head nears the face, hydraulic pressure is released, and the force of the cutters against the face 21 pushes them into their proper position for drilling. In raise drilling operations, it is many times desirable to lower the raise head down the completed or partially completed raise. This may be necessary in order to change damaged or worn-out cutters or to remove the raise head from the completed raise. Lowering of the raise head can be difficult and time consuming because the gage cutters have a tendency to hang up on the wall of the hole as the head is lowered, particularly on non-vertical holes. Lowering the head can cause considerable damage to the gage cutters as the surf area scrubs the wall on the way down. In addition, the unsupported drill pipe and stabilizers are subjected to unusual loads which are believed to be prime factors in some premature drill string failures. After new cutters are installed and the raise head starts back up the raise, the new cutters will generally cut a slightly larger hole than the old, worn cutter did; therefore, the head must ream this small amount which causes excessive wear on the outer rows of the gage cutters.

The double-acting hydraulic cylinder 20 has been actuated causing the saddle 18 to pivot about hinge 19. The rolling cutter 16 has been moved away from the wall of the hole 17 a distance "A". This allows the raise head 10 to be easily and efficiently lowered back through the portion of the completed hole 17. A pin 23 projects from the plate 15. The pin 23 fits within the cavity 22 in the saddle 18 when the saddle 18 is in the seated position. This provides a high degree of stability to the saddle 18 and cutter 16.

Referring now to FIGS. 3–7, a series of circuit diagrams illustrate the extension and retraction of the gage cutters 16.

The cutters 16 and saddles 18 are moved to and from the retracted position by the hydraulic cylinder 20. The gage cutters are shown in the fully extended position in FIG. 3 (also in FIG. 1). As shown in FIGS. 3–7, item 1 is an air-driven hydraulic intensifier. Item 20 is the double-acting hydraulic cylinder which is attached to and moves the saddles 18 which contain the raise cutters 16. Item 3 is a four-way hydraulic valve and item 4 is a low-pressure hydraulic actuator. Items 5 and 6 are limit switches. Item 7 is a small, short-stroke, single-acting, spring return, hydraulic cylinder. Items 8 and 9 are flow control valves.

The raise drilling operation begins by drilling a small diameter pilot hole through the earth from a first location to an opening at the second location using a small diameter pilot bit. After the pilot hole is completed, the pilot bit is removed from the drill string and the raise head 10 attached. The raise head 10 is rotated and drawn along the pilot hole, thereby enlarging the pilot hole to the desired size. In the position shown in FIG. 3, the gage cutters 16 are fully extended. The air flowing through the control manifold 2 is flowing past the cylinder rod of item 7 to atmosphere. The gage cutters 16 and saddles 18 are locked in position for the raise drilling operation.

Figure 4:
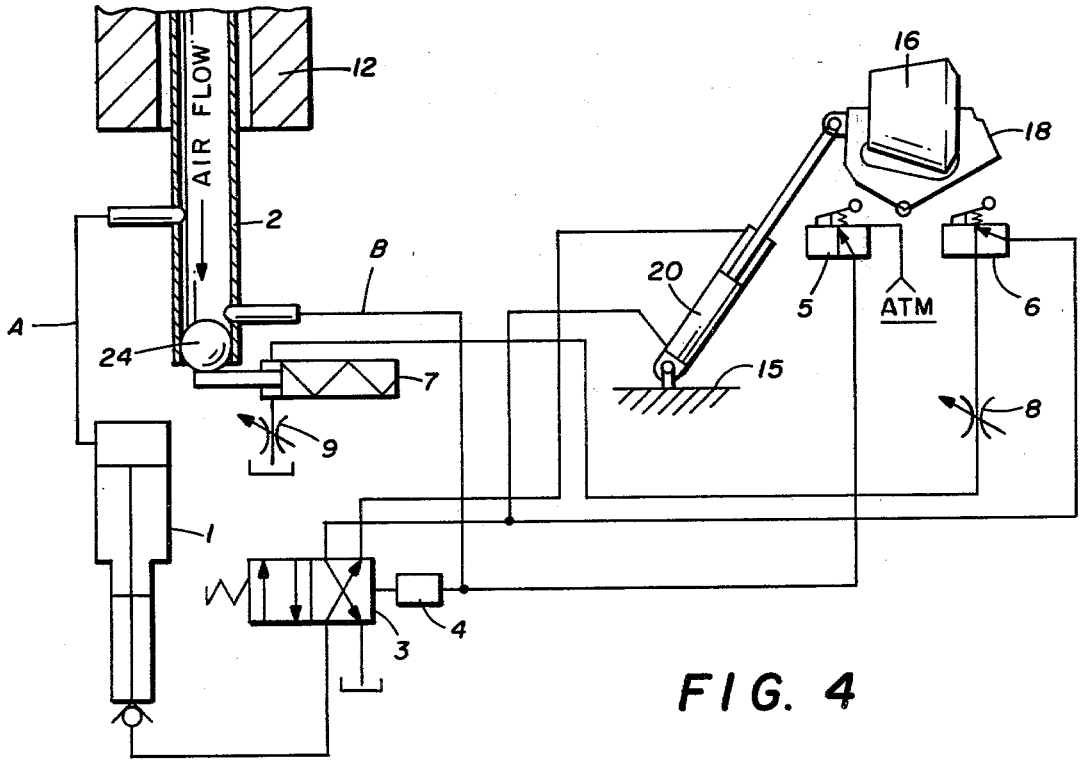

As shown in FIG. 4, the present invention allows the raise head 10 to be lowered back through the completed portion of the raise hole 17. The raise head 10 is lowered slightly away from the face 21. The gage cutters 16 are retracted, decreasing the diameter of the raise head. This allows sufficient clearance along the wall of the hole to allow the raise head to be easily lowered. A rubber ball 24 is dropped through the raise machine swivel (not shown). It falls into the manifold 2 thus blocking the exit of air. The air enters lines A and B which activates items 1 and 4. Item 4 activates at a lower pressure than item 1 thus ensuring that item 3 shifts to the proper position before pumping begins. Item 3 opens which allows high pressure oil to flow into the rod side of item 20. The gage saddle 18 begins to retract. Oil is forced out of the piston side of item 20 and follows the path of least resistance to tank.

Figure 5:
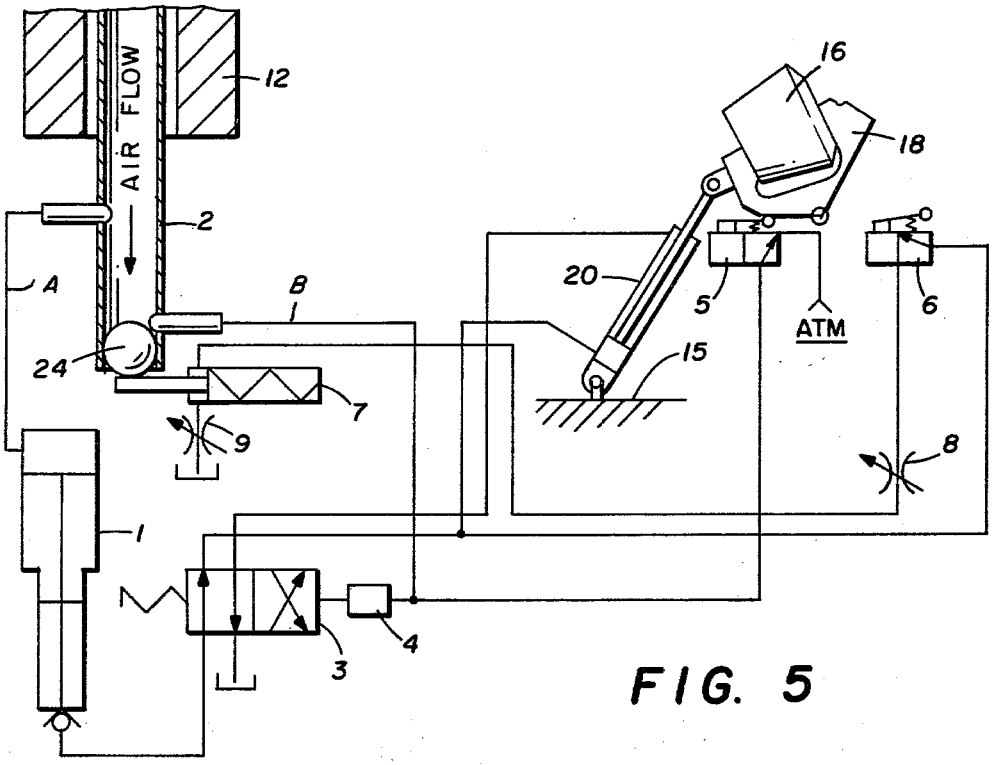

Referring now to FIG. 5, the gage cutters 16 are shown in the fully retracted position. As the saddle 18 tips over to its fully retracted position, item 5 is tripped which allows the air to exit to atmosphere, thus item 1 stops pumping. The raise head 10 can be lowered back through the completed portion of the raise hole 17. New gage cutters 16 can be positioned in the saddles 18 and the raise head 10 returned to the face 21. The new cutters would normally cut a slightly larger hole than the old, worn cutters did. Prior to the present invention the new gage cutters would ream this small amount of hole and cause excessive wear on the outer rows of the gage cutters. With the present invention the raise head 10 can be moved back into position with the gage cutters in the retracted position preventing wear on the outer rows of the gage cutters.

Figure 6:
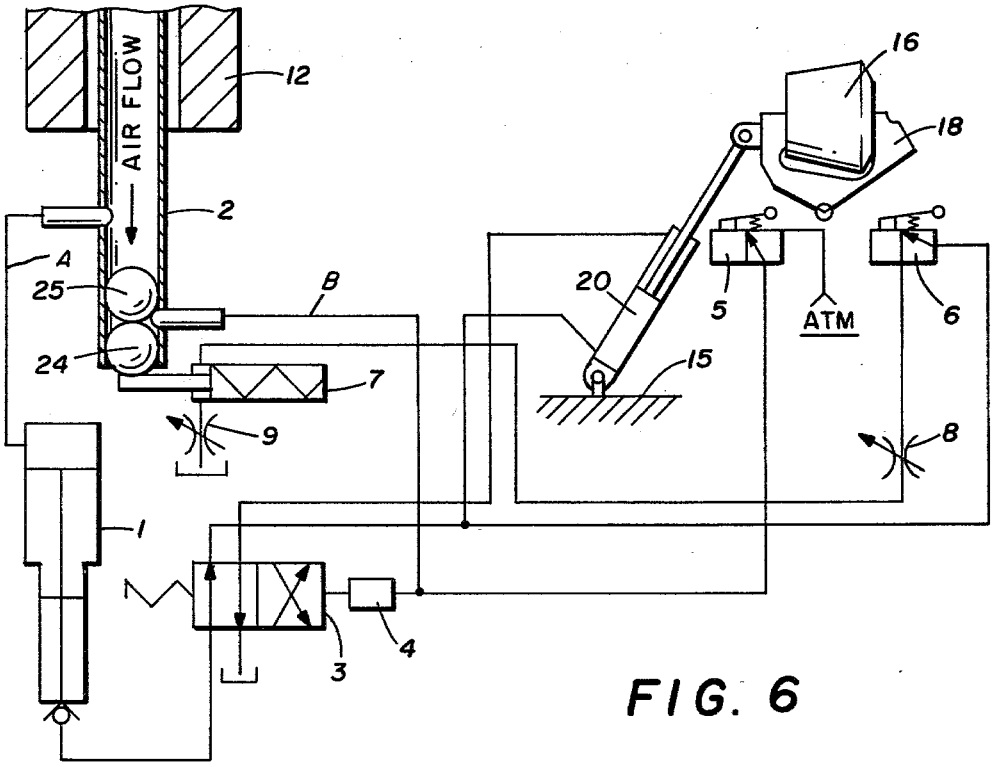

When the raise head 10 is back in position to continue the raise boring operation, the gage cutters 16 are extended to the fully extended operating position. This is illustrated in FIG. 6. A second rubber ball 25 is dropped through the raise machine into the manifold 2 sealing off Line B. Line A becomes pressurized activating item 1. High pressure oil flows through item 3 into the piston side of item 20. The double-acting hydraulic cylinder, item 20, extends causing the saddle 18 to rotate about hinge 19.

Figure 7:
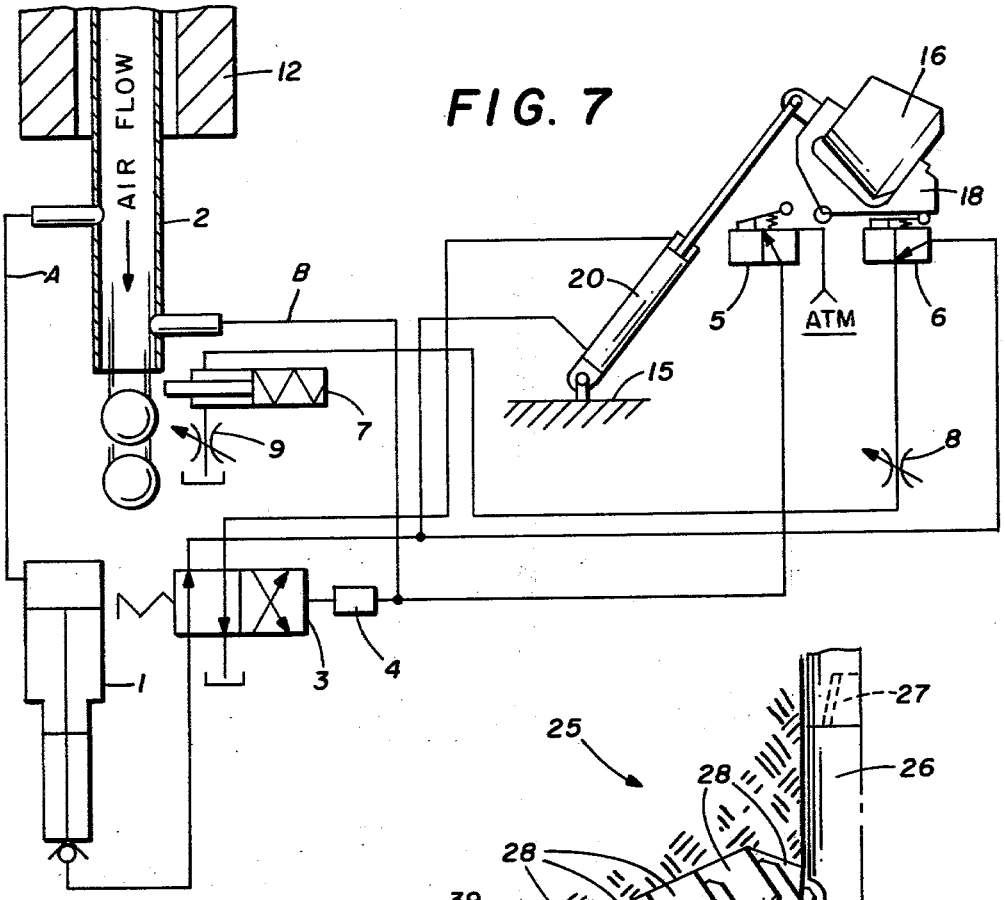

Referring now to FIG. 7, the gage cutters 16 are again shown in their fully extended position. The system is reset and ready for operation in the manner previously described. As the saddle 18 tips over to its fully extended position, item 6 is tripped allowing oil to flow into item 7. The cylinder rod of item 7 retracts allowing the rubber balls 24 and 25 to be exhausted. Item 1 stops pumping. Oil leaks through item 9 back to tank thus allowing the cylinder rod of item 7 to return to its idle position.

Figure 8:
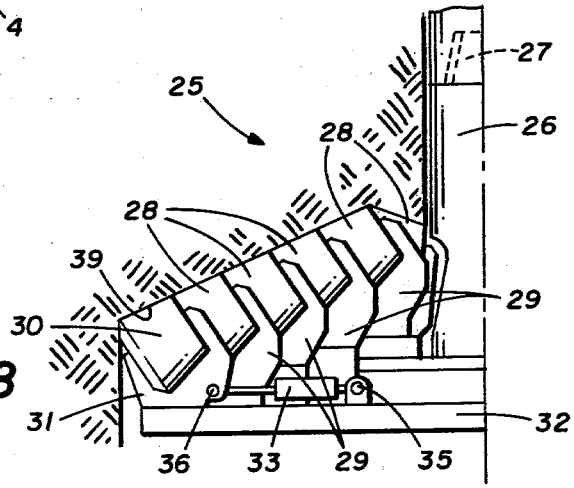
FIGS. 8 and 9 illustrate another embodiment of a raise head constructed in accordance with the present invention.

Referring now to FIG. 8, a cutaway view of another embodiment of a raise head 25 constructed in accordance with the present invention is shown. A drive stem 26 projects from the main body portion of the raise head 25. The upper portion of the drive stem 26 is threaded with threads 27 to allow the raise head 25 to be easily connected to, and disconnected from, a rotary drill string (not shown). During the boring of a large diameter raise hole, a small diameter pilot hole is initially drilled from a first location to a second location. The small diameter pilot bit is disconnected from the drill string and a raise head such as raise head 25 is connected to the drill string. The drill string is rotated and an axial force is applied to the drill string. The raise head is rotated and drawn along the small diameter pilot hole to form the desired large diameter raise hole.

A multiplicity of rolling cutters 28 for disintegrating the formations out to a first radius from the central axis of raise head 25 to form a portion of the body of raise head 25. The rolling cutters 28 are mounted in a series of cutter saddles 29 that form a portion of the body of the raise head 25. The plate 32 supports the saddles 29. It is to be understood that the raise head 25 includes other cutter saddles and cutters mounted around the stem 26 in a manner well known in the art. As the head 25 is rotated, the cutters 28 will contact and disintegrate the formations out to a first radius from the central axis of the raise head 25.

A multiplicity of gage cutters 30 are located radially outside the cutters 28 and are adapted to disintegrate the formations between the first radius and a second and greater radius from the central axis of the raise head 25. The cutters 30 cut what is known as the gage of the hole 38. The cutters 30 are mounted in cutter saddles 31. The cutters 30 and saddles 31 are mounted to slide along frame 32. The cutters 30 and saddles 31 can be selectively moved radially outward from the central axis of the raise head 25. The saddles 31 are mounted to slide along a "T" frame on the support frame 32. The rolling cutters 30 can thereby be selectively moved radially outward from the central axis of the raise head 25. A double-acting hydraulic cylinder 33 is connected between the supporting frame 32 and the saddles 31. Actuation of cylinder 33 will move the cutters 30 radially inward or outward. The raise head 25 is shown with the gage cutters 30 expanded to the gage cutting position in FIG. 8.

Figure 9:
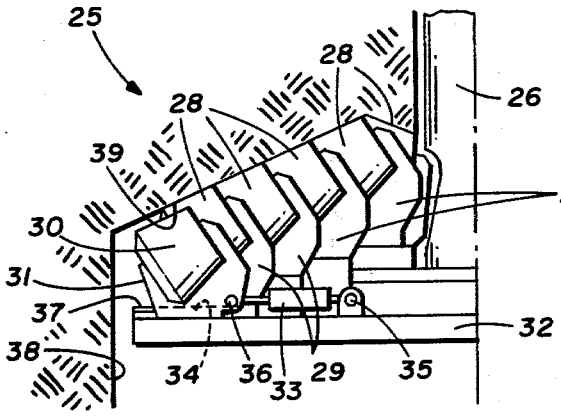

Referring now to FIG. 9, the raise head 25 is shown with the gage cutters 30 in the retracted position. The raise head 25 has been lowered slightly away from the face 39. The gage cutters 30 have been retracted hydraulically, decreasing the diameter of the raise head. This allows sufficient clearance along the wall of the hole 38 to allow the raise head 25 to be easily lowered. The worn cutters may then be replaced with new cutters and the head pulled back up the raise. As the head nears the face, hydraulic pressure is released, and the force of the cutters against the face 39 pushes them into their proper position for drilling. The saddles 31 slide along the plate 32 in response to force from the double-acting hydraulic cylinder 33. A "T" groove 34 in the bottom of the saddles 31 mates with the "T" bar on the plate 32. This allows the saddles 31 and cutter to slide easily yet provides stability during the earth boring operation. Retraction and extension of the cutters 30 and saddles may be controlled by a pneumatic-hydraulic circuit such as that shown in FIGS. 3–7.

The embodiments of the invention in which an exclusive property or privilege is claimed are defined as follows:

1. A raise bit for enlarging a pilot hole into a larger diameter raise hole by being attached to a rotary drill string and rotated and drawn upward by said rotary drill string thereby disintegrating portions of the earth formations surrounding the pilot hole to form a larger diameter raise hole and allowing the portions of the formations to fall freely down the large diameter raise hole, comprising:

a bit body defining a bit axis of rotation, said bit body including a plate positioned perpendicular to said bit axis of rotation, said plate forming the lowermost portion of said bit body;

a drive stem projecting perpendicularly upward from said bit body along said bit axis of rotation, said drive stem including threads to allow said raise bit to be connected to said rotary drill string;

primary cutter means on said bit body located above said plate, said primary cutter means positioned at a first radial distance from said bit axis of rotation for disintegrating the earth formations out to said first radial distance from said bit axis of rotation;

gage cutter means positioned on a moveable support means, said moveable support means located above said plate;

means for allowing said gage cutter means and said moveable support means to be moved relative to said bit body thereby selectively positioning said gage cutter means at a gage cutting position wherein said gage cutter means disintegrates the earth formations out to a radial distance from said bit axis of rotation that is greater than said first radial distance and selectively positioning said gage cutter means within said first radial distance; and force means for selectively moving said gage cutter means and moveable support means to said gage cutting position wherein gage cutter means disintegrates the earth formations out to a radial distance from said bit axis of rotation that is greater than said first radial distance and selectively positioning said gage cutter means within said first radial distance to allow said raise bit to be lowered back through said larger diameter hole.

2. The raise bit of claim 1 wherein said means for allowing said gage cutter means and said moveable support means to be moved relative to said bit body comprises a hinge element that allows said moveable frame to rotate with respect to said bit body.

3. The raise bit of claim 2 wherein said force means is a double-acting cylinder connected between said bit body and said moveable support means.

4. The raise bit of claim 3 wherein said means for allowing said secondary cutter means and said moveable support means to be moved relative to said bit body comprises an elongated bar on said bit body and a matching groove in said moveable support means.

5. A method of raise boring to produce a large diameter raise hole that allows a raise head to be lowered back through the completed portion of the large diameter raise hole, comprising the steps of:

drilling a small diameter pilot hole from a first location to a second location using a rotary drill string with a pilot bit attached;

removing the pilot bit from the rotary drill string;

connecting a riase boring head to a rotary drill string that extends through said pilot hole wherein said raise boring head includes a central axis, primary rolling cutter means for disintegrating the formations out to a first radial distance from said central axis and retractable rolling gage cutter means adapted to be selectively located at a second radial distance that is greater than said first radial distance from said central axis;

locating said retractable rolling gage cutter means at said second radial distance from said central axis;

applying an axial force to said rotary drill string, rotating said rotary drill string with said raise boring head attached and drawing said raise boring head along said small diameter pilot hole to form said large diameter raise hole;

retracting said rolling gage cutter means substantially within said first radial distance; and lowering said raise head back through said large diameter raise hole.

6. The method of raise boring of claim 5 wherein said primary roller cutter means and said retractable roller gage cutter means have replaceable roller cutters, including the steps of:

replacing said replaceable roller cutters of said primary roller cutter means and said retractable roller gage cutter means;

maintaining said roller gage cutter means substantially within said first radial distance;

moving said raise head back through said large diameter raise hole;

locating said retractable rolling gage cutter means at said second radial distance from said central axis; and applying an axial force to said rotary drill string, rotating said rotary drill string with said raise boring head attached and drawing said raise boring head along said small diameter pilot hole to continue said large diameter raise hole.

* * * * *

UNITED STATES PATENT AND TRADEMARK OFFICE

CERTIFICATE OF CORRECTION

PATENT NO. : 4,194,578

DATED : March 25, 1980

INVENTOR(S) : Howard E. Mitchell

It is certified that error appears in the above–identified patent and that said Letters Patent are hereby corrected as shown below:

Column 7, line 41, delete "3" and insert therefor --1--.

Signed and Sealed this

*Seventeenth* Day of *June 1980*

[SEAL]

*Attest:*

SIDNEY A. DIAMOND

*Attesting Officer*

*Commissioner of Patents and Trademarks*